United States Patent [19]

Clear

[11] Patent Number: 4,692,066

[45] Date of Patent: Sep. 8, 1987

[54] CATHODIC PROTECTION OF REINFORCED CONCRETE IN CONTACT WITH CONDUCTIVE LIQUID

[76] Inventor: Kenneth C. Clear, 201 Davis Dr., Unit GG, Sterling, Va. 22170

[21] Appl. No.: 840,737

[22] Filed: Mar. 18, 1986

[51] Int. Cl.[4] ..... E02D 31/06

[52] U.S. Cl. ..... 405/216; 204/147; 204/196; 405/211

[58] Field of Search ..... 405/211, 195, 216; 204/147, 196, 197

[56] References Cited

U.S. PATENT DOCUMENTS

| | | | |
|---|---|---|---|
| 2,273,897 | 2/1942 | Scott | 204/196 X |
| 2,817,634 | 12/1957 | McCall | 204/147 X |
| 3,151,050 | 9/1964 | Wilburn | 204/196 X |
| 3,410,772 | 11/1968 | Geld et al. | 204/147 |
| 3,475,304 | 10/1969 | Currey | 204/196 |
| 3,689,389 | 9/1972 | Waggener | 204/196 X |
| 4,255,241 | 3/1981 | Kroon et al. | 204/196 X |
| 4,502,929 | 3/1985 | Stewart et al. | 204/196 X |
| 4,506,485 | 3/1985 | Apostolos | 204/196 X |

*Primary Examiner*—Dennis L. Taylor
*Attorney, Agent, or Firm*—John J. Freer

[57] ABSTRACT

This invention relates to a reinforced concrete structure of enhanced corrosion resistance. The invention structure finds particular utility in service in brackish or saline water. The reinforced concrete of the structure is, on its surface, in contact with a low resistivity grout. Anode elements are in contact with the grout, such as at the surface of the reinforced concrete or by partial or full embedment in the grout. Together with this combination, a high resistivity material is provided as a covering over the low resistivity grout and anode elements. The resulting structure is especially useful when in contact with seawater, and most particularly seawater subject to tidal action.

20 Claims, 2 Drawing Figures

CATHODIC PROTECTION OF REINFORCED CONCRETE IN CONTACT WITH CONDUCTIVE LIQUID

BACKGROUND OF THE INVENTION

Where reinforced concrete is in contact with seawater or diluted seawater (brackish water), such as in pilings or support structures for bridges, dock structures, or seawater canals, it is subject to a very high rate of corrosion. Corrosion is accelerated in this area due to high salt concentration and because of the availability of oxygen for the cathodic reaction. The availability of oxygen is especially important since the rate of corrosion is often cathode limited. Conditions of alternate wet and dry cycles therefore create an ideal situation for rapid corrosion.

This has recently been recognized as a significant problem, but no successful system for the cathodic protection of reinforcing steel has yet been developed for structures in contact with seawater. The major obstacles to the use of cathodic protection in this case has been the leakage of the impressed current into the seawater.

The most critical area is the area of very high corrosion near the tide level. The area above high tide level also undergoes corrosion, and it is desirable to apply cathodic protection to this portion of the structure as well.

In the past, anodes such as conductive paints have been applied to the outside of such columns. These efforts were unsuccessful since the apPlied current is easily leaked or diverted into the seawater during periods of high tide or when the structure is subjected to waves or swells. This occurs since full strength seawater has a specific resistivity of about 20 ohm-cm, providing a much more conductive path to ground than the concrete in the structure, which has a specific resistivity of 5000–15,000 ohm-cm. If a substantial amount of current is leaked to the seawater rather than being directed into the concrete structure, the reinforcing steel will not be cathodically protected. If on the other hand, the anodes are placed high enough on the structure that current leakage does not occur, the critical area of highest corrosion will not be protected.

In order to leak significant amounts of current to the seawater, direct contact between the anode and seawater need not occur. Current can travel a short distance through the concrete near the structure surface and then into the seawater, again avoiding the reinforcing steel and providing no cathodic protection.

This process results not only in ineffective protection, but also in damage to the anodes and to the anode-concrete interface. This damage occurs because the anodes and interface are specifically designed not to exceed a current density of 10 mA/ft$^2$ of anode surface. A higher current density is known to shorten anode lifetime and to generate sufficient acid to damage the concrete near the anode surface. When current leakage occurs, an area of very high current will be present near the seawater level, causing anode and acid damage.

SUMMARY OF THE INVENTION

This invention provides a novel structure for insuring that substantially all the current applied to a steel reinforced concrete structure is directed inward to the steel reinforcing, and only a very minor amount is leaked to electrical ground through surrounding liquid.

In one aspect, the invention is directed to a steel reinforced concrete structure adapted for contact with conductive liquid, and particularly for contact with saline water subject to variations in level, such variations thereby creating a high corrosion zone for steel reinforced concrete that comes in and out of liquid contact. The structure comprises: an anode assembly adjacent to the surface of the reinforced concrete and located at least in part along the high corrosion zone; a grout in contact with the anode assembly as well as in contact with said reinforced concrete, such grout having a low specific resistivity; and an air porous concrete covering over the grout, with the concrete covering having a high specific resistivity.

Other aspects of the invention include composite structure as discussed hereinabove and useful for cathodic protection of substrates in contact therewith, as well as the method of retarding corrosion in steel reinforced concrete.

DESCRIPTION OF THE PREFERRED EMBODIMENTS

In general, this invention will find utility in any application where a reinforced concrete comes in contact with a conductive liquid, being thereby subjected to corrosion for which cathodic protection will be serviceable. For convenience, the conductive liquid will often be referred to herein simply as seawater. It is however to be understood that the invention will find use in contact with other conductive liquids such as brackish water of a lower salt content than seawater, as well as saline solutions that may contain one or more dissolved salts in solution.

Figure 1:
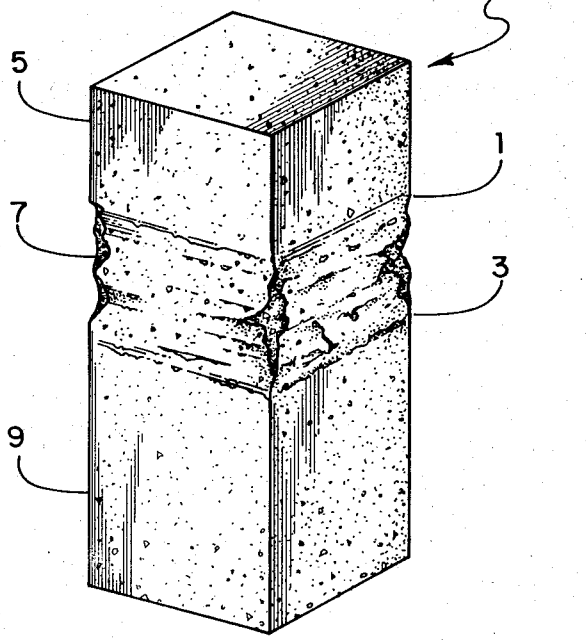
FIG. 1 shows a reinforced concrete column exhibiting a high and low tide level.

Referring then to the Figures, FIG. 1 shows a reinforced concrete column shown generally at 10. This column 10 has been in contact with conductive liquid subject to variation in level, e.g., the tidal action of seawater. The concrete column 10 thereby exhibits a high tide level 1 and a low tide level 3 and therebetween a very high corrosion zone 7. Above the high tide level 1 the concrete structure 10 exhibits a moderate corrosion zone 5. This moderate corrosion zone 5 will be exposed typically to air, but can also be subjected to occasional liquid contact, e.g., splashing action such as from wind-blow spray. Below the low tide level 3 is a low corrosion zone 9 which can be expected to be always or virtually always in liquid contact, e.g., with seawater.

Figure 2:
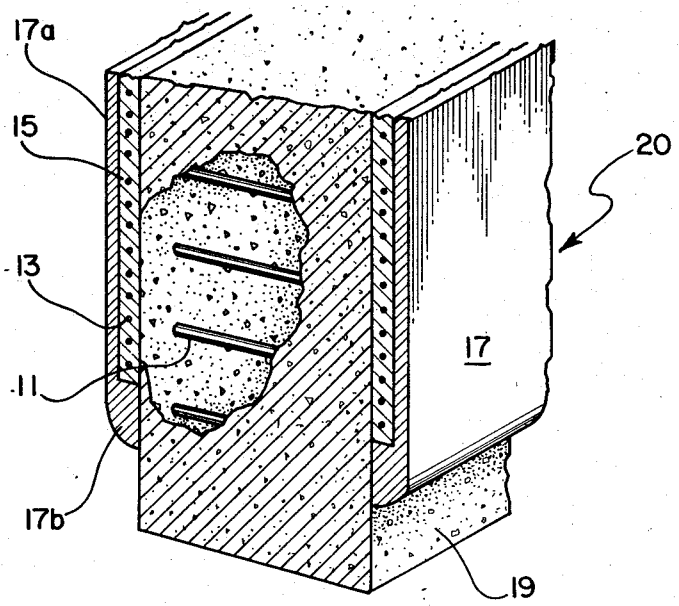
FIG. 2 shows a reinforced concrete column in section and protected by cathodic protection structure of the present invention.

Referring then to FIG. 2, a column of reinforced concrete protected from corrosion is shown generally at 20. This protected concrete structure is of reinforced concrete 19, generally square shaped in cross-section, having internal steel reinforcing bars 11. For corrosion protection, adjacent the surface of the reinforced concrete 19, but shown slightly spaced apart therefrom, there is employed an anode assembly 13. This anode assembly is embedded in a body of low specific resistivity grout 15, which may also be referred to herein simply as the "low resistivity grout 15". This body of low specific resistivity grout 15 envelopes the anode assembly 13. At the outer surface of the low specific resistivity grout 15 is a covering of air porous concrete 17 of high specific resistivity. Because of the high specific resistivity of this porous concrete 17, it may sometimes be referred to herein as the "outer resistance covering 17," or "high resistivity concrete 17". This covering of air porous concrete 17 is comprised of a general wall-like cover member 17*a* and a heel 17*b*. The heel 17*b* extends below the bottom edge of the low specific resistivity grout 15 and therefore comes in contact with the reinforced concrete 19. In this way, the covering of air porous concrete 17 provides for a complete cover for the low specific resistivity grout 15.

The anode assembly 13 for providing cathodic protection to the reinforced concrete 19 can be at the surface of the concrete 19 and covered by the grout 15 or can be actually embedded in the grout 15. Or the anode assembly 13 need only be in contact with the grout 15, as by contact at its outer surface or by partial embedment therein, the grout 15 thereby providing a filling for the space between the anode assembly 13 and the reinforced concrete 19.

The low specific resistivity grout 15 will usually be present as a covering on the underlying reinforced concrete 19 in a layer having a depth within the range of from about 0.25 inch (0.64 cm.) to 2.5 inches (6.4 cm.). A depth of grout 15 of less than about 0.25 inch (0.64 cm.) may be difficult to apply uniformly. On the other hand, a depth of grout 15 of greater than about 2.5 inches (6.4 cm.) can be uneconomical. Preferably for best economy and enhanced corrosion resistance, such grout 15 will be present at a depth within the range of from about 0.8 to 2.0 inches (2–5 cm.).

The anode assembly 13, as well as the low specific resistivity grout 15 is then covered by an air porous concrete 17. By being air porous concrete 17 it is meant that this concrete 17 is sufficiently porous to permit the venting through this concrete 17 of any gases that might be generated during cathodic protection, such venting being at least sufficient to not deleteriously accelerate corrosion of the underlying reinforced concrete 19. The covering of air porous concrete 17 will be applied typically in a layer having a thickness within the range of between about 0.25 and 2.5 inches (0.64–6.4 cm.). A thickness of less than about 0.25 inch (0.64 cm.) for the cover of air porous concrete 17 may lead to unacceptable erosion of the covering and shortening of the cathodic protection life for the underlying reinforced concrete 19. On the other hand, a thickness of this covering of greater than about 2.5 inches (6.4 cm.) can be uneconomical. Preferably for best maintenance and economy, the air porous concrete 17 is provided at a thickness within the range of from about 0.8 to 2 inches (2–5 cm.).

It is critical that the air porous concrete 17 completely cover the anode assembly 13 and the underlying low specific resistivity grout 15 where such assembly 13 or grout 15 may be subject to liquid contact. Thus, in any area of the protected concrete structure 20 where exposure only to the atmosphere will be typical, e.g., the area where the anodic assembly 13 will be connected to a power source, it is sufficient that the grout 15 not be covered by the air porous concrete 17. But on the other hand, particularly where the protected structure will be subjected to rising and falling liquid level, such as tidal action with seawater, the air porous concrete heel 17*b* as shown in FIG. 2 should extend at least about 4 inches (10 cm.) below the bottom edge of the grout 15. Preferably for best prevention of current leakage through the protecting structure to the seawater, such heel 17*b* extends about 12 inches (30 cm.) or more below the grout 15.

When the specific resistivity of the low resistivity grout 15 is expressed as $R_I$ and the resistivity of the air porous concrete 17 has a specific resistivity expressed as $R_o$ it is most advantageous for prolonged corrosion protection that the resistivity between the layers be adjusted such that $R_o >> R_I$. Usually this relationship will be such that the resistivity $R_o$ will be greater by an amount within the range of from about 5 to about 200 times the resistivity of $R_I$. Preferably for best corrosion protection as well as prolonged service for the underlying reinforced concrete 19, the relationship of resistivities is such that $R_o$ is greater than $R_I$ by an amount within the range of from about 10 to about 100 times greater.

Generally for the column 20, the reinforced concrete 19 will be made of Portland Cement which can be expected to have a specific resistivity within the range of from about 5000 to about 15,000 ohm-cm. The reinforced concrete 19 will have bars 11 of generally either conventional or prestressed reinforcing steel. Suitable anode assemblies 13 which can be used, e.g., on the reinforced concrete 19, are well known in the art and include conductive paints, conductive carbon filled resin, carbon loaded thermoplastics, and catalyzed titanium structures.

For the low resistivity grout 15 there will most always be used a grout having a specific resistivity of less than about 50,000 ohm-cm. Thus, grouts which may be suitably used include a pumpable grout, which can have a typical resistivity on the order of about 1,200 ohm-cm., or a lightweight concrete, which may have a resistivity within the range of from about 22,000 to about 42,000 ohm-cm. Bearing in mind that it is the above-discussed relationship of specific resistivity between grout and concrete that is most important, it is nevertheless typical that the high resistivity concrete 17 will have a specific resistivity exceeding about 50,000 ohm-cm. For this high resistivity concrete layer 17, a microsilica cement may suitably be employed. A serviceable cement may be one having 20 weight percent of microsilica cement and this can have a resistivity within the range of from about 150,000 to about 250,000 ohm-cm.

It should be understood that any method of application of the anode assembly 13, low resistivity grout 15, and high resistivity concrete 17, which results at least substantially in the configuration variations described herein, such as the arrangement shown in FIG. 2, will be serviceable for the purposes of this invention. One particularly suitable method of installation is realized by first attaching the anode assembly 13 to the reinforced concrete 19 by using non-conductive retaining members such as plastic pegs or studs. It is to be understood that by the use herein of the term "anode assembly" there may be included in addition to specific anode elements such as catalyzed titanium structures, additional attendant elements such as current lead-in wiring, which additional elements may include non-conductive retaining members where appropriate. Once the anode assembly 13 is in place it can then be covered with the low resistivity grout 15 by spraying, commonly referred to as shotcreting, or by casting the grout by pouring or pumping behind a form spaced apart from the reinforced concrete 19. After the low resistivity grout 15 is in place the high resistivity concrete 17 can then be placed, again by either spraying, or pumping or pouring utilizing a form.

It is also contemplated that precast structures of the high resistivity concrete 17 will be useful. When such are prefabricated, the anode assembly 13 may be mounted on the inside face of these precast structures, e.g., on the face of precast panels. Suitable mounting procedures for such method have been discussed hereinbefore. These panels can then be mounted on the underlying reinforced concrete 19, but spaced apart therefrom. This space is then filled with the low specific resistivity grout 15 by either pumping or pouring to completely fill the space and contact the anode assembly 13.

It is also contemplated that in any of the foregoing methods, the high resistivity concrete 17 can be replaced, wholly or in part, by a suitable insulating plastic such as FRP. Where this alternative structure is used, the insulating plastic must be sufficiently thin, e.g, a quarter inch thickness (0.6 cm.) or less, or have small holes drilled therethrough to allow for the venting of gases through the plastic.

Following the installation as described herein, the anode assembly 13 is electrically connected to the positive pole of a suitable power supply, and the reinforcing steel 11 of the concrete structure 20 is connected to the negative pole of the power supply. A direct current suitable for the cathodic protection of the reinforcing steel 11 is then applied. It is contemplated that any power source suitable for use with anode assemblies, where such assemblies are used in protecting concrete such as in bridge decks and the like, will be useful in the present invention.

I claim:

1. A steel reinforced concrete structure adapted for contact with conductive liquid, and particularly for contact with saline water subject to variations in level, said variations thereby creating a high corrosion zone for steel reinforced concrete that comes in and out of liquid contact, said structure comprising:

an anode assembly adjacent to the surface of said reinforced concrete and located at least in part along said high corrosion zone;

a grout in contact with said anode assembly as well as in contact with said reinforced concrete, said grout having a low specific resistivity; and an air porous concrete covering over said grout, said concrete covering having a high specific resistivity.

2. The concrete structure of claim 1 wherein said anode assembly is in contact at least in part with said reinforced concrete.

3. The concrete structure of claim 1 wherein said anode assembly is in contact at least in part with said porous concrete covering.

4. The concrete structure of claim 1 wherein said grout and said porous concrete are each present as a layer having a thickness within the range of from about 0.25 inch (0.64 cm.) to about 2.5 inches (6.4 cm.).

5. The concrete structure of claim 1 wherein said grout is a low resistivity grout having a specific resistivity of less than about 50,000 ohm-cm. and said porous concrete is a high resistivity grout having a specific resistivity of greater than about 50,000 ohm-cm.

6. The concrete structure of claim 1 wherein said grout is of low specific resistivity $R_I$ and said porous concrete covering is of high specific resistivity $R_o$ and the resistivity existing between said grout and said concrete is expressed by the relationship $R_o >> R_I$.

7. The concrete structure of claim 6 wherein the resistivity existing between said grout and said concrete is expressed by the relationship $R_o > (5\text{–}200)\ R_I$.

8. The concrete structure of claim 1 wherein said porous concrete extends downwardly into contact with said reinforced concrete as well as into contact with said conductive liquid, and said extension exceeds the lowest edge of said grout by a distance within the range of from about 4 inches (10 cm.) to about 12 inches (30 cm.).

9. A composite structure for cathodic protection of substrates in contact therewith, said composite structure comprising:

an anode assembly;

a grout in contact with said anode assembly, said grout having a low specific resistivity; and an air porous concrete covering over said grout, said concrete covering having a high specific resistivity.

10. The composite structure of claim 9 wherein said anode assembly is in contact at least in part with said substrate.

11. The composite structure of claim 9 wherein said anode assembly is in contact at least in part with said porous concrete covering.

12. The composite structure of claim 9 wherein said grout contacts said substrate.

13. The composite structure of claim 9 wherein said grout and said porous concrete composite covering are each present as a layer having a thickness within the range of from about 0.25 inch (0.64 cm.) to about 2.5 inches (6.4 cm.).

14. The composite structure of claim 9 wherein said grout is a low resistivity grout having a specific resistivity of less than about 50,000 ohm-cm. and said porous concrete is a high resistivity grout having a specific resistivity of greater than about 50,000 ohm-cm.

15. The composite structure of claim 9 wherein said grout is of low specific resistivity $R_I$ and said porous concrete covering is of high specific resistivity $R_o$ and the resistivity existing between said grout and said concrete is expressed by the relationship $R_o >> R_I$.

16. The composite structure of claim 15 wherein the resistivity existing between said grout and said concrete is expressed by the relationship $R_o > (5\text{–}200) R_I$.

17. The method of retarding corrosion in a steel reinforced concrete, and particularly such reinforced concrete in contact with conductive liquid subject to variations in level, thereby creating a high corrosion zone of said reinforced concrete that comes in and out of liquid contact, which method comprises:

establishing an anode assembly adjacent to the surface of said reinforced concrete and located at least in part along said high corrosion zone;

grouting said reinforced concrete with a grout of low specific resistivity, said grout being at least in contact with said anode assembly; and covering said grout with an air porous concrete of high specific resistivity.

18. The method of claim 17 wherein said grouting employs a grout of low specific resistivity $R_I$ and said covering employs an air porous concrete of high specific resistivity $R_o$ and the resistivity existing between said grout and said concrete is expressed by the relationship $R_o >> R_I$.

19. The method of claim 17 wherein said anode assembly is established in contact at least in part with said reinforced concrete.

20. The method of claim 17 wherein said air porous concrete is prefabricated, said anode assembly is established in contact with the prefabricated concrete and the resulting combination is brought together with said grout in a manner such that the prefabricated concrete covers said anode assembly.

* * * * *